United States Patent [19]

Shimizu et al.

[11] Patent Number: 4,474,146

[45] Date of Patent: Oct. 2, 1984

[54] CYLINDER BLOCK

[75] Inventors: Yutaka Shimizu; Harumi Sakuma, both of Tokyo, Japan

[73] Assignee: Nissan Motor Co., Ltd., Yokohama, Japan

[21] Appl. No.: 371,733

[22] Filed: Apr. 26, 1982

[30] Foreign Application Priority Data

Apr. 28, 1981 [JP] Japan ..... 56-64591

[51] Int. Cl.[3] ..... F02F 7/00

[52] U.S. Cl. ..... 123/90.34; 123/90.33; 123/195 R; 123/195 H; 184/6.5; 384/438

[58] Field of Search ..... 123/90.33, 90.34, 195 R, 123/52 A; 384/438, 403; 184/6.5

[56] References Cited

U.S. PATENT DOCUMENTS 2,681,054 6/1954 Boghossian ..... 123/195 R
2,893,358 7/1959 Bauer ..... 123/195 R
3,164,143 1/1965 Dolza ..... 123/195 R
3,540,425 11/1970 Scheiterlein et al. ..... 123/195 R

*Primary Examiner*—Craig R. Feinberg
*Assistant Examiner*—David A. Okonsky
*Attorney, Agent, or Firm*—Schwartz, Jeffery, Schwaab, Mack, Blumenthal & Koch

[57] ABSTRACT

A cylinder block comprises bearing sections for supporting a rotatable shaft disposed within a crankcase inner chamber, the bearing sections being spaced from each other and from main bearing sections for supporting a crankshaft; and generally cylindrical hollow beam members each of which is interposed between the two opposite bearing sections in a manner to cover the rotatable shaft supported by the bearing sections, the hollow beam members being aligned in the direction of the row of cylinder barrels, thereby effectively increasing the total rigidity of the cylinder block while achieving engine weight-lightening.

6 Claims, 4 Drawing Figures

CYLINDER BLOCK

BACKGROUND OF THE INVENTION

1. Field of the Invention

This invention relates to a cylinder block of an internal combustion engine, arranged to lower the noise level of the engine.

2. Description of the Prior Art

As a cause of engine noise, there is vibration noise emitted from a so-called cylinder block skirt or lower section and an oil pan which noise is caused by the vibration of a cylinder block. In order to reduce such vibration noise it seems enough to suppress vibration, due to explosion torque, applied to a crankshaft by increasing the rigidity of the cylinder block. However, this unavoidably leads to an increase in cylinder block wall thickness and accordingly to a great increase in engine weight, thereby giving rise to new problems such as a deteriorated fuel economy. In view of this, a variety of propositions have been made to improve the rigidity of the cylinder block while suppressing the increase in cylinder block weight.

BRIEF SUMMARY OF THE INVENTION

In accordance with the present invention, the cylinder block is provided with cylinder barrels and a crankcase inner chamber. The crankcase inner chamber comprises a plurality of bearing sections for supporting a rotatable shaft disposed within the crankcase inner chamber. The bearing sections are spaced from each other and from main bearing sections for supporting a crankshaft. Additionally, a plurality of generally cylindrical hollow beam members are so provided that each is interposed between the two opposite bearing sections so as to connect them in a manner to cover the rotatable shaft supported by the bearing sections. The hollow beam members are aligned in the direction of the row of the cylinder barrels. With the thus arranged cylinder block, the cylinder block is increased in flexural and torsional rigidity while achieving engine weight lightening, thereby effectively lowering engine noise level.

BRIEF DESCRIPTION OF THE DRAWINGS

The features and advantages of the cylinder block of the present invention will be more clearly appreciated from the following description taken in conjunction with the accompanying drawings in which the same reference numerals designate the same parts and elements, in which.

DETAILED DESCRIPTION OF THE INVENTION

Figure 1A:
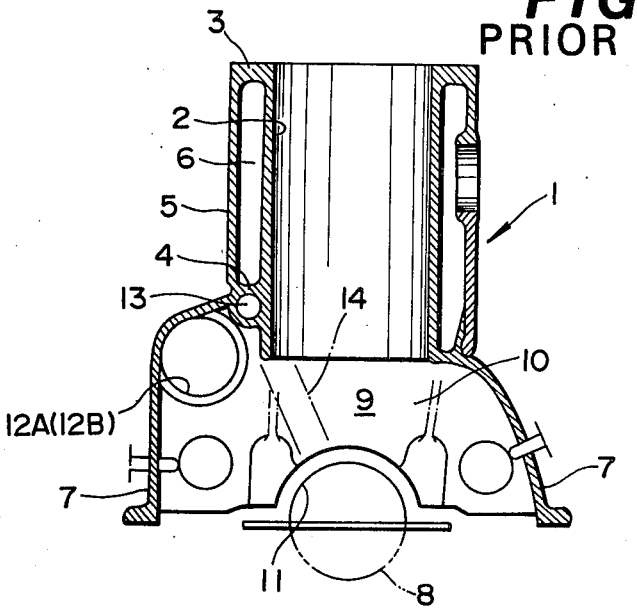
FIG.1A PRIOR ART
FIG. 1A is a vertical sectional view of a conventional cylinder block.
Figure 1B:
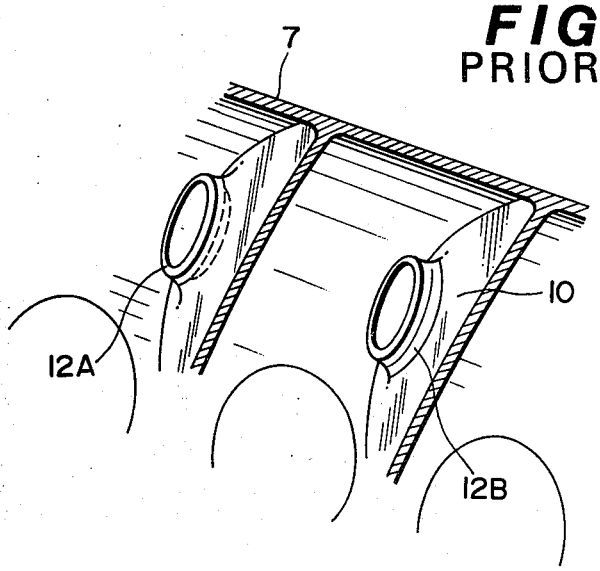
FIG.1B PRIOR ART
FIG. 1B is a perspective view of an essential part of the conventional cylinder block of FIG. 1.

Referring to FIGS. 1A and 1B, a conventional cylinder block 1 will be described along with its major shortcomings. The cylinder block 1 is formed with a plurality of cylinder barrels 2 which are connected through upper and lower block decks 3, 4 with a cylinder block outer wall 5. Defined between cylinder barrels 2 and the cylinder block outer wall 5 is a water jacket 6 through which engine coolant circulates. A cylinder head (not shown) will be secured on the top surface of the upper block deck 3 by means of head bolts (not shown). A so-called cylinder block skirt section 7 is securely connected to the lower block deck 4 and extends downwardly. The skirt section 7 is bulged laterally and outwardly in the downward direction in order to be located outside of the envelope of the outer-most loci of a rotating system including a crankshaft 8 and connecting rods (not shown). An oil pan (not shown) will be securely connected to the bottom edge of the skirt section 7, so that a crankcase inner chamber 9 is defined between the skirt section 7 and the oil pan.

A plurality of main bearing bulkheads 10 are integrally connected to the inner wall of the skirt section 7 in such a manner as to divide the crankcase inner chamber 9 into a plurality of parts in the direction of the row of the cylinder barrels 2. Each bearing bulkhead 10 is formed with a main bearing section 11 for rotatably supporting the journal of the crankshaft 8. Each bearing bulkhead 10 is further formed with another bearing section 12A(12B) for rotatably supporting one of various shaft members, for example, a shaft for driving engine accessories such as an oil pump, or a camshaft for operating intake and exhaust valves. The bearing section 12A(12B) is located in the vicinity of the lower block deck 4 and formed in the shape of a boss having a central opening as shown in FIG. 1B. The above-mentioned shaft member is rotatably supported by the bearing sections 12A, 12B and disposed within the crankcase inner chamber 9 in such a manner as to extend in the direction of the row of the cylinder barrels 2. In this connection, to obtain a space for the shaft member within the crankcase inner chamber 9, the cylinder block skirt section 7 is formed to be further bulged outwardly as shown in FIG. 1A. The reference numeral 13 denotes an oil passage from which lubricating oil is supplied through an oil supply passage 14 to the main bearing section 11.

However, the above-mentioned conventional cylinder block 1 has encountered the following shortcomings: The cylinder block is so constructed that the cylinder block skirt section 7 is largely bulged outwardly from the lower block deck 4. Accordingly, the skirt section 7 tends to readily vibrate, which induces vibration of the oil pan, thus emitting considerable vibration noise from the engine. Such a tendency of noise emission is remarkable particularly in cases where the wall thickness of the cylinder block is less and/or the cylinder block is formed of light alloy from the point of view of weight-lightening. Because, in such cases, the vicinity of the lower block deck 4 is further lowered in rigidity, and therefore the cylinder block 1 readily deforms by flexure in the axial direction of the cylinder block and by torsion around the axis of the crankshaft 8, which flexure and torsion are caused, for example, due to explosion pressure within cylinder barrels. Since such deformation of the cylinder block repeatedly takes place, the cylinder block skirt section 7 is vibrated, thereby causing the oil pan to largely vibrate. As discussed above, engine weight-lightening seems to be inconsistent with engine noise reduction, and therefore it is difficult to obtain an engine which is light in weight and of low noise level.

Figure 2A:
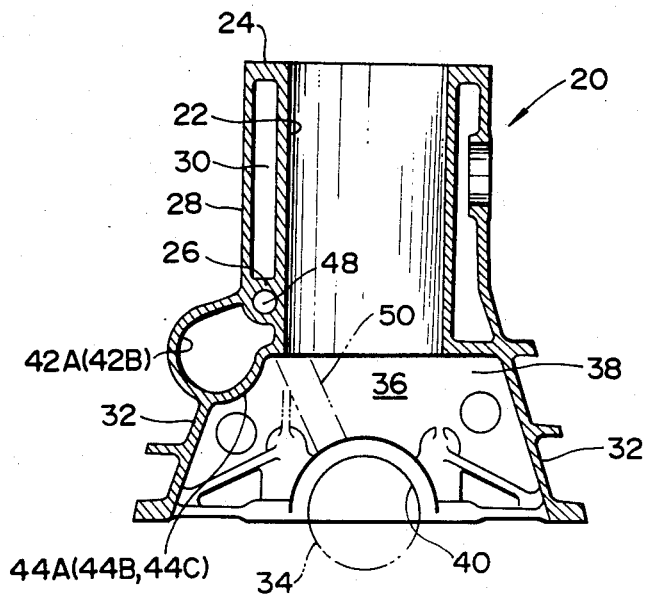
FIG. 2A is a vertical sectional view of a preferred embodiment of a cylinder block in accordance with the present invention.
Figure 2B:
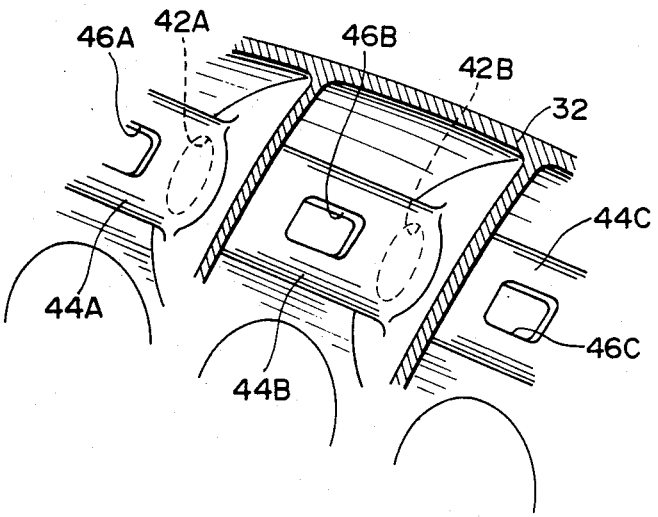
FIG. 2B is a perspective view of an essential part of the cylinder block of FIG. 2A.

In view of the above description of the conventional cylinder block, reference is now made to FIGS. 2A and 2B, wherein a preferred embodiment of a cylinder block of the present invention is illustrated by the reference numeral 20. The cylinder block 20 is, for example, of an automotive internal combustion engine. The cylinder block 20 is composed of a plurality of cylinder barrels 22 which are connected through upper and lower block decks 24, 26 with a cylinder block outer wall 28. A water jacket 30 is defined between the cylinder barrels 22 and the outer wall 28. An engine coolant circulates through the water jacket 30. A cylinder head (not shown) will be secured on the top surface of the upper block deck 24 by means of head bolts (not shown). A so-called cylinder block skirt section 32 is integrally connected to the lower block deck 26 and extends downwardly so as to be located outside of the envelope of the outer-most loci (not shown) of a rotating system including a crankshaft 34 and connecting rods (not shown). An oil pan (not shown) will be secured to the bottom edge of the skirt section 32, so that a crankcase inner chamber 36 is defined between the skirt section 32 and the oil pan.

A plurality of main bearing bulkheads 38 are integrally connected to the inner wall of the skirt section 32 in a manner to divide the crankcase inner chamber 36 into a plurality of sections along the axis of the cylinder block or the crankshaft 34. Each bearing bulkhead 38 is formed at its lower central part with a main bearing section 40 for rotatably supporting the journal of the crankshaft 34.

As shown, each bearing bulkhead 38 is further formed with another bearing section 42A(42B) for supporting a rotatable shaft (not shown) except for the crankshaft 34. The rotatable shaft is, for example, a drive shaft for driving an engine accessory such as an oil pump, or a camshaft for operating intake and exhaust valves. The bearing section 42A(42B) is generally annular and defines thereinside a simple opening through which the rotatable shaft is rotatably disposed.

Additionally, the annular bearing sections 42A, 42B of the oppositely located bearing bulkheads 38 are connected by a generally cylindrical hollow beam member 44A(44B, 44C) so that the openings of the annular bearing sections 42A, 42B merge into the inside opening of the hollow beam member 44B. The hollow beam member 44B is formed integrally with the bearing bulkheads 32 and so disposed as to cover the rotatable shaft which is rotatably supported by the bearing sections 42A, 42B. It will be understood that the other cylindrical beam members 44A, 44C are disposed in the same manner as in the hollow beam member 44B.

As best shown in FIG. 2B, the hollow beam members 44A, 44B, 44C are so aligned that their axes lie on a straight line which extends along the axis of the cylinder block 20 and the crankshaft 34, i.e. in the direction of the row of the cylinder barrels 22, so that the aligned hollow beam members serve as a straight hollow beam structure which is located in the vicinity of the lower block deck 26 and extends along the cylinder block axis or the row of the cylinder barrels. It will be appreciated that the hollow beam members 44A, 44B, 44C are produced integrally with the block skirt section 32 and the bearing bulkheads 38 during casting of the cylinder block 20.

In this instance, the cylindrical beam member 44A (44B, 44C) is generally in the shape of a cylinder having an inner diameter of not less than 30 mm and a basic thickness of not less than 4 mm. Besides, the cylindrical beam member 44A (44B, 44C) is formed with a rectangular opening 46A (46B, 46C) at the wall facing to the crankcase inner chamber 36, which rectangular opening serves to prevent interference of the outermost rotation loci of the rotating system including the crankshaft 34 and the connecting rods with the beam member 44A (44B, 44C), and to allow lubricating oil to drop therethrough. The beam members 44A, 44B, 44C are not limited in the shape having a generally annular section, and accordingly may be of the shape of a plygonal cylinder. The reference numeral 48 denotes an oil passage from which lubricating oil is supplied through an oil supply passage 50 to the main bearing sections 40.

Thus, since the cylinder block 20 is so constructed and arranged that the straight hollow beam structure extends along the cylinder block axis in such a manner as to pierce the crankcase inner chamber 36, the cylinder block 20 is improved in its flexural rigidity in the direction of the cylinder block axis and in its torsional rigidity around the crankshaft axis. Furthermore, in this instance, the straight hollow beam structure is disposed in the vicinity of the lower block deck 26, and therefore the structure and lower block deck constitute a so-called double-wall construction, thereby further improving the rigidity of the lower block deck 26.

As a result, deformation of the cylinder block 20 due to flexure in the cylinder block axis and to torsion around the crankshaft axis is suppressed, thereby greatly decreasing the vibration of the block skirt section 32 and the oil pan which vibration is generated by repeated input of the above-mentioned flexure and torsion. This noticeably suppresses vibration noise emitted from the cylinder block 20.

Moreover, the beam members 44A, 44B, 44C are hollow and therefore the rigidity of the cylinder block can be increased without a considerable weight increase. In other words, it becomes possible to decrease the thickness of the cylinder block wall by an amount corresponding to the above-mentioned rigidity increase, thereby resulting in the weight-lightening of the engine.

As will be appreciated from the above, according to the present invention, the cylinder block is provided with a hollow beam structure which is constructed upon employing the bearing sections for supporting the rotatable shaft except for the crankshaft. The hollow beam structure is formed in such a manner as to pierce the crankcase inner chamber in the direction of the cylinder block axis. Therefore, the rigidity of the cylinder block is improved in flexural and torsional rigidity in the cylinder block axis direction, without a noticeable weight increase of the cyliner block. This lowers the vibration level of the whole cylinder block, thus effectively lowering engine noise.

What is claimed is:

1. A cylinder block having cylinder barrels disposed in a row having a direction and a skirt section defining a crankcase inner chamber having a plurality of main bearing sections for supporting a crankshaft, comprising:

a plurality of secondary bearing sections for supporting a rotatable shaft disposed within the crankcase inner chamber, said secondary bearing sections disposed in groups of two opposite secondary bearing sections and being spaced from each other and from said main bearing sections; and a plurality of generally cylindrical hollow beam members each of which is interposed between two of said opposite secondary bearing sections so as to connect said two of said opposite secondary bearing sections in a manner to cover the rotatable shaft supported by said secondary bearing sections, said hollow beam members being aligned in the direction of the row of the cylinder barrels, said cylindrical hollow beam members being integral with the cylinder block skirt section.

2. A cylinder block as claimed in claim 1, further comprising a plurality of main bearing bulkheads formed with said secondary bearing sections, respectively, and with said main bearing sections, respectively.

3. A cylinder block as claimed in claim 2, wherein said secondary bearing sections are aligned in the direction of the row of the cylinder barrels, each bearing section defining an opening in which the rotatable shaft is disposed, said opening mergings into an inside space of said hollow beam member.

4. A cylinder block as claimed in claim 3, wherein said hollow beam members are integral with said main bearing bulkheads.

5. A cylinder block as claimed in claim 4, wherein a part of each hollow beam member constitutes a part of said cylinder block skirt section which defines the crankcase inner chamber.

6. A cylinder block as claimed in claim 5, wherein each hollow beam member comprises an outer wall having an opening for preventing interference of an outermost loci of a rotating system including the crankshaft, and for allowing lubricating oil to drop therethrough.

* * * * *